US009306276B2

(12) United States Patent
Shi et al.

(10) Patent No.: US 9,306,276 B2
(45) Date of Patent: Apr. 5, 2016

(54) WIDEBAND ANTENNA SYSTEM WITH MULTIPLE ANTENNAS AND AT LEAST ONE PARASITIC ELEMENT

(75) Inventors: Guining Shi, San Diego, CA (US); Allen Minh-Triet Tran, San Diego, CA (US); Elizabeth M. Wyrwich, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 340 days.

(21) Appl. No.: 13/181,796

(22) Filed: Jul. 13, 2011

(65) Prior Publication Data

US 2013/0016024 A1 Jan. 17, 2013

(51) Int. Cl.

| | |
|---|---|
| ***H01Q 19/02*** | (2006.01) |
| ***H01Q 1/52*** | (2006.01) |
| ***H01Q 1/24*** | (2006.01) |
| ***H01Q 9/42*** | (2006.01) |
| ***H01Q 5/25*** | (2015.01) |
| ***H01Q 5/371*** | (2015.01) |

(52) U.S. Cl.

CPC ..... *H01Q 1/521* (2013.01); *H01Q 1/243* (2013.01); *H01Q 5/25* (2015.01); *H01Q 5/371* (2015.01); *H01Q 9/42* (2013.01); *Y10T 29/49016* (2015.01); *Y10T 29/5313* (2015.01)

(58) Field of Classification Search

CPC ..... H01Q 1/521; H01Q 9/42

USPC ..... 343/833

See application file for complete search history.

(56) References Cited

U.S. PATENT DOCUMENTS

| | | | | |
|---|---|---|---|---|
| 7,239,290 | B2 * | 7/2007 | Poilasne et al. | 343/866 |
| 2008/0136712 | A1 * | 6/2008 | Suzuki | 343/700 MS |
| 2009/0027286 | A1 | 1/2009 | Ohishi et al. | |

(Continued)

FOREIGN PATENT DOCUMENTS

| | | | |
|---|---|---|---|
| CN | 101048915 | A | 10/2007 |
| CN | 201430211 | Y | 3/2010 |

(Continued)

OTHER PUBLICATIONS

Boag, A.; "Reduction of mutual coupling by near-field coupled resonators," Microwaves, Communications, Antennas and Electronics Systems, 2009. COMCAS 2009. IEEE International Conference; Publication Year: 2009 , pp. 1-4.

(Continued)

*Primary Examiner* — Hoang V Nguyen
*Assistant Examiner* — Michael Bouizza
(74) *Attorney, Agent, or Firm* — James Gutierrez

(57) ABSTRACT

A wideband antenna system with multiple antennas and at least one parasitic element is disclosed. In an exemplary design, an apparatus includes a first antenna, a second antenna, and a parasitic element. The first antenna has a shape of an open-ended loop with two ends that overlap and are separated by a gap. The second antenna may also have a shape of an open-ended loop with two ends that overlap and are separated by a gap. The parasitic element is located between the first and second antennas. The first and second antennas may be placed side by side on a board, located at either the top end or the bottom end of a wireless device, and/or formed on opposite sides (e.g., the front and back sides) of the board. The parasitic element may be formed on a plane that is perpendicular to the plane on which the first and second antennas are formed.

23 Claims, 8 Drawing Sheets

(56) References Cited

U.S. PATENT DOCUMENTS

| | | | | |
|---|---|---|---|---|
| 2009/0091507 | A1* | 4/2009 | Chung et al. | 343/841 |
| 2010/0156726 | A1* | 6/2010 | Montgomery et al. | 343/700 MS |
| 2011/0074641 | A1 | 3/2011 | Sotoma et al. | |
| 2011/0148736 | A1 | 6/2011 | Choi et al. | |

FOREIGN PATENT DOCUMENTS

| | | | |
|---|---|---|---|
| CN | 101821902 | A | 9/2010 |
| EP | 2083472 | A1 | 7/2009 |
| JP | 2009033548 | A | 2/2009 |
| JP | 2011077714 | A | 4/2011 |
| JP | 2011109190 | A | 6/2011 |
| WO | 0271536 | | 9/2001 |
| WO | WO-2010028521 | A1 | 3/2010 |

OTHER PUBLICATIONS

Su, H.-L. et al.; "Dual-Band Insulator Design by Stacking Capacitively Loaded Loops for MIMO Antennas," Electronics Letters; vol. 46 , Issue: 20; Publication Year: 2010 , pp. 1364-1365.

Morioka et al. "Effects of a Parasitic Wire on Coupling Between Two Slot Antennas," Proceedings of ISAP2000, Fukuoka, Japan, Aug. 21-25, 2000.

International Search Report and Written Opinion—PCT/US2012/046801—ISA/EPO—Oct. 23, 2012.

Sarabandi K., et al., "Subwavelength Radio Repeater System Utilizing Miniaturized Antennas and Metamaterial Channel Isolator", IEEE Transactions on Antennas and Propagation, IEEE Service Center, Piscataway, NJ, US, vol. 59, No. 7, Jul. 1, 2011, pp. 2683-2690, XP011369390.

* cited by examiner

WIDEBAND ANTENNA SYSTEM WITH MULTIPLE ANTENNAS AND AT LEAST ONE PARASITIC ELEMENT

BACKGROUND

I. Field

The present disclosure relates generally to communication, and more specifically to an antenna system for a wireless device.

II. Background

A wireless device (e.g., a cellular phone or a smart phone) may include a transmitter and a receiver coupled to an antenna to support two-way communication. For data transmission, the transmitter may modulate a radio frequency (RF) carrier signal with data to obtain a modulated signal, amplify the modulated signal to obtain a transmit (TX) signal having the proper signal level, and transmit the TX signal via the antenna to a base station. For data reception, the receiver may obtain a receive (RX) signal via the antenna and may condition and process the RX signal to recover data sent by the base station.

A wireless device may include multiple transmitters and/or multiple receivers coupled to multiple antennas in order to improve performance. For example, multiple transmitters may simultaneously transmit multiple signals via multiple antennas to send multiple transmissions for different functions (e.g., voice and data), to achieve transmit diversity, to support multiple-input multiple-output (MIMO) transmission, etc. Multiple receivers may also simultaneously receive multiple signals from multiple antennas to recover transmissions sent for different functions, to achieve receive diversity, to support MIMO transmission, etc. The use of multiple antennas may improve performance for both data transmission and data reception.

It may be challenging to design and build multiple antennas on a wireless device due to various reasons. First, the wireless device may be portable and have a small size, and it may be challenging to fit multiple antennas in the wireless device due to the small form factor. Second, it may be challenging to obtain good performance for all antennas. Third, it may be challenging to obtain the desired isolation between multiple antennas within the wireless device.

DETAILED DESCRIPTION

The detailed description set forth below is intended as a description of exemplary designs of the present disclosure and is not intended to represent the only designs in which the present disclosure can be practiced. The term "exemplary" is used herein to mean "serving as an example, instance, or illustration." Any design described herein as "exemplary" is not necessarily to be construed as preferred or advantageous over other designs. The detailed description includes specific details for the purpose of providing a thorough understanding of the exemplary designs of the present disclosure. It will be apparent to those skilled in the art that the exemplary designs described herein may be practiced without these specific details. In some instances, well-known structures and devices are shown in block diagram form in order to avoid obscuring the novelty of the exemplary designs presented herein.

A wideband antenna system with multiple antennas and at least one parasitic element is described herein. The wideband antenna system may be used for various electronic devices such as wireless devices (e.g., cellular phones, smart phones, wireless modems, etc.) tablets, personal digital assistants (PDAs), handheld devices, laptop computers, smartbooks, netbooks, cordless phones, wireless local loop (WLL) stations, Bluetooth devices, consumer electronic devices, etc. For clarity, the use of the wideband antenna system for a wireless device is described below.

Figure 1:
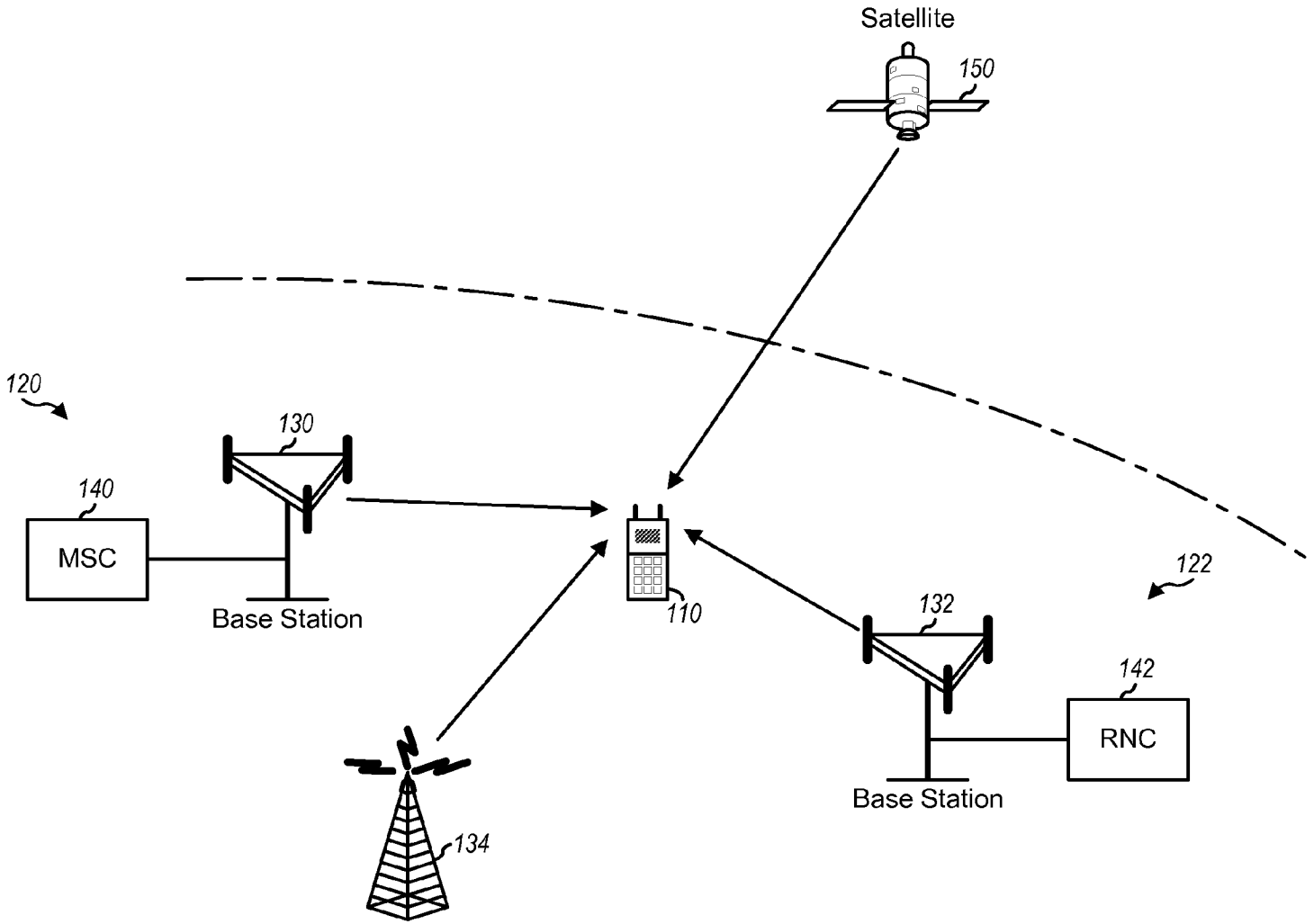
FIG. 1 shows a wireless device communicating with multiple wireless systems.

FIG. 1 shows a wireless device 110 capable of communicating with multiple wireless communication systems 120 and 122. Wireless system 120 may be a Code Division Multiple Access (CDMA) system, which may implement Wideband CDMA (WCDMA), cdma2000, or some other version of CDMA. Wireless system 122 may be a Global System for Mobile Communications (GSM) system, a Long Term Evolution (LTE) system, a wireless local area network (WLAN) system, etc. For simplicity, FIG. 1 shows wireless system 120 including one base station 130 and one mobile switching center (MSC) 140, and system 122 including one base station 132 and one radio network controller (RNC). In general, each system may include any number of base stations and any set of network entities.

Wireless device 110 may also be referred to as a user equipment (UE), a mobile station, a terminal, an access terminal, a subscriber unit, a station, etc. Wireless device 110 may be equipped with any number of antennas. In an exemplary design, wireless device 110 includes two antennas. Multiple antennas may be used to simultaneously support multiple services (e.g., voice and data), to provide diversity against deleterious path effects (e.g., fading, multipath, and interference), to support MIMO transmission to increase data rate, and/or to obtain other benefits. Wireless device 110 may be capable of communicating with wireless system 120 and/or 122. Wireless device 110 may also be capable of receiving signals from broadcast stations (e.g., a broadcast station 134). Wireless device 110 may also be capable of receiving signals from satellites (e.g., a satellite 150) in one or more global navigation satellite systems (GNSS).

In general, wireless device 110 may support communication with any number of wireless systems, which may employ any radio technologies such as WCDMA, cdma2000, GSM, LTE, GPS, etc. Wireless device 110 may also support operation on any number of frequency bands.

Figure 2:
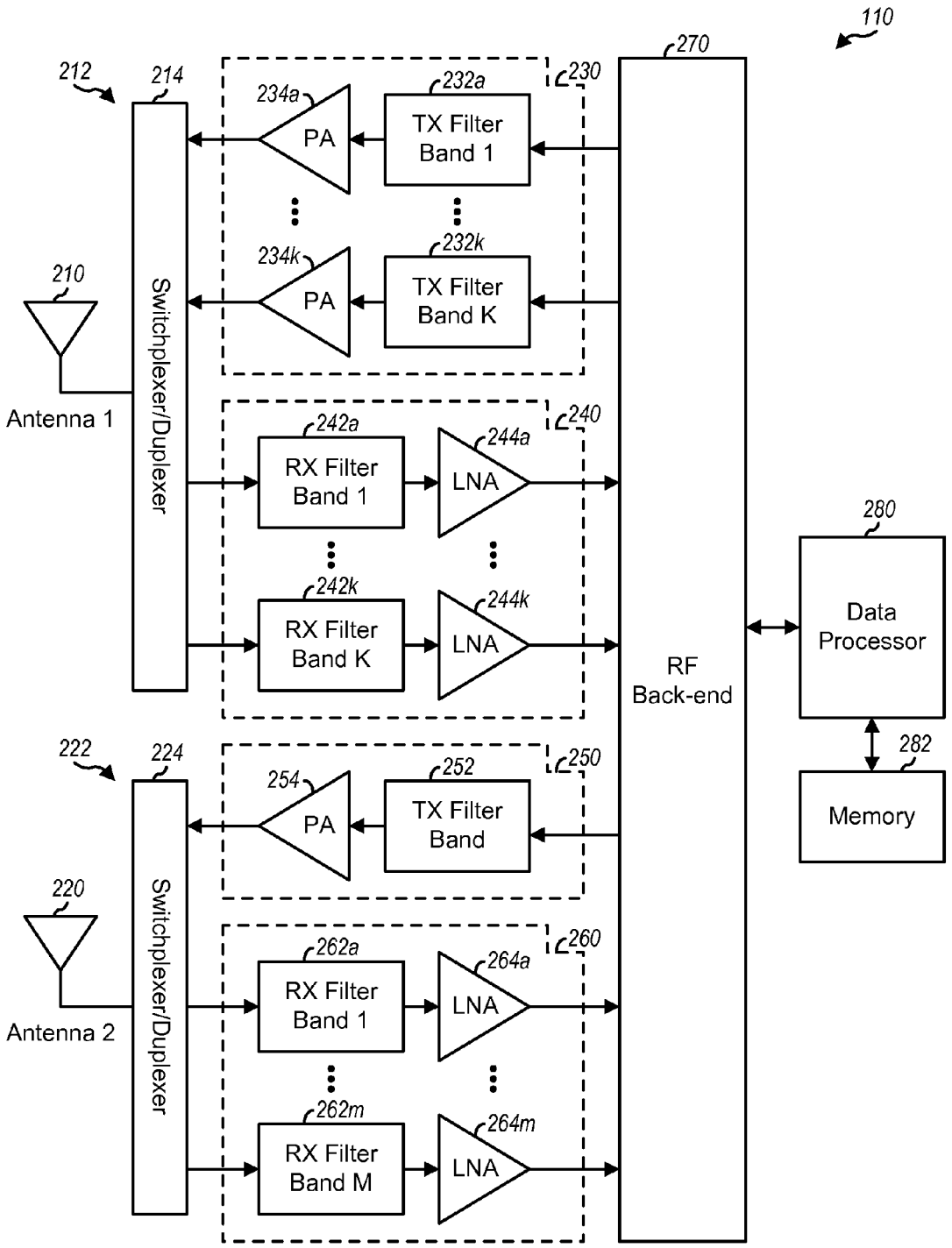
FIG. 2 shows a block diagram of the wireless device.

FIG. 2 shows a block diagram of an exemplary design of wireless device 110 with two antennas. In this exemplary design, wireless device 110 includes a first antenna 210 (antenna 1) coupled to a first section 212 and a second antenna 220 (antenna 2) coupled to a second section 222. Section 212 includes a transmit (TX) module 230 supporting data transmission on multiple (K) frequency bands and a receive (RX) module 240 supporting data reception on the K frequency bands, where K may be any integer value. Section 222 includes a TX module 250 supporting data transmission on one or more frequency bands and an RX module 260 supporting data reception on multiple (M) frequency bands. In general, TX modules 230 and 250 may support the same or different frequency bands. Similarly, RX modules 240 and 260 may support the same or different frequency bands.

Within first section 212, a switchplexer/duplexer 214 performs switching and/or routing to (i) couple either TX module 230 or RX module 240 to first antenna 210, (ii) couple an appropriate transmit path within TX module 230 to first antenna 210 during data transmission, and (iii) couple an appropriate receive path within RX module 240 to first antenna 210 during data reception. Switchplexer/duplexer 214 has an antenna port coupled to first antenna 210 and input/output (I/O) ports coupled to K transmit paths within TX module 230 and K receive paths within RX module 240. Switchplexer 214 couples the antenna port to one of the I/O ports at any given moment.

TX module 230 includes K transmit paths, which may support different frequency bands and/or different wireless systems. For example, one transmit path may be used for each frequency band of interest. Each transmit path includes a TX filter 232 and a power amplifier (PA) 234. TX filters 232*a* through 232*k* for K transmit paths receive output RF signals (which may be for different frequency bands) from an RF back-end 270 and provide filtered signals to PAs 234*a* through 234*k*, respectively. PAs 234*a* through P234*k* amplify their filtered signals and provide TX signals, which are routed through switchplexer/duplexer 214 and transmitted via first antenna 210.

RX module 240 includes K receive paths, which may support different frequency bands and/or different wireless systems. For example, one receive path may be used for each frequency band of interest. Each receive path includes an RX filter 242 coupled to a low noise amplifier (LNA) 244. RX filters 242*a* through 242*k* for K receive paths filter their RX signals (which may be for different frequency bands) and provide filtered signals to LNAs 244*a* through 244*k*, respectively. LNAs 244*a* through 244*k* amplify their filtered signals and provide input RF signals to RF back-end 270. Switchplexer/duplexer 214 selects a frequency band of operation for first section 212 and couples an RX signal from first antenna 210 to the receive path for the selected frequency band.

Within second section 222, a switchplexer/duplexer 224 has an antenna port coupled to second antenna 220 and I/O ports coupled to a transmit path within TX module 250 and M receive paths within RX module 260. TX module 250 includes a TX filter 252 and a power amplifier 254 for one transmit path. RX module 260 includes an RX filter 262 and a LNA 264 for each receive path. Switchplexer 224 selects a frequency band of operation for second section 222 and couples an RX signal from second antenna 220 to the receive path for the selected frequency band.

RF back-end 270 may include various circuit blocks such as downconverters, upconverters, amplifiers, filters, buffers, etc. RF back-end 270 may frequency downconvert, amplify and filter an input RF signal from any one of the LNAs and provide an input baseband signal to a data processor 280. RF back-end 270 may also amplify, filter and frequency upconvert an output baseband signal and provide an output RF signal to one of TX filters 232 and 252. All or a portion of modules 230, 240, 250 and 260 and RF back-end 270 may be implemented on one or more analog integrated circuits (ICs), RF ICs (RFICs), mixed-signal ICs, etc.

Data processor 280 may perform various functions for wireless device 110, e.g., processing for data being transmitted and received. A memory 282 may store program codes and data for data processor 280. Data processor 280 may be implemented on one or more application specific integrated circuits (ASICs) and/or other ICs.

The design of wireless device 110 may be challenging for various reasons. First, wireless device 110 may be portable and have a small size. Hence, the size, thickness, and antenna volume of wireless device 110 should be as small as possible. Second, wireless device 110 may require antennas 210 and 220 to both transmit and receive, e.g., to support simultaneous voice and data. Hence, both antennas 210 and 220 should have good antenna efficiency. This is opposed to a case in which antenna 220 is a diversity/secondary antenna used only for data reception and hence can have lower antenna efficiency. Third, wireless device 110 may support operation over a broad frequency range, which may cover multiple frequency bands. For example, antenna 210 may support operation from 704 MHz to 960 MHz and also from 1710 MHz to 2170 MHz. Hence, antennas 210 and/or 220 should have good performance over the broad frequency range supported by wireless device 110. Fourth, since antennas 210 and 220 can both transmit, antennas 210 and 220 should have good isolation in order to reduce inter-modulation effect. The isolation requirements of antennas 210 and 220 may be more stringent than for an antenna system with a primary antenna that both transmits and receives and a diversity antenna that only receives.

In an aspect, a wideband antenna system with multiple antennas and at least one parasitic element is described herein. A parasitic element is a conductor (e.g., a conductive metal trace or wire arranged in a loop) that conducts current and is not directly applied with any signal. However, a parasitic element may pick up signals from nearby antennas and/or circuits via coupling through the air and/or some other means. A parasitic element may also be referred to as a parasitic loop, a ground loop, etc. In one design, the wideband antenna system includes two antennas implemented in a relatively small volume and having good performance (e.g., high antenna efficiency) and good isolation over a broad frequency range. These two antennas may be used for antennas 210 and 220 in wireless device 110. The wideband antenna system may also have other desirable characteristics, as described below.

Figure 3:
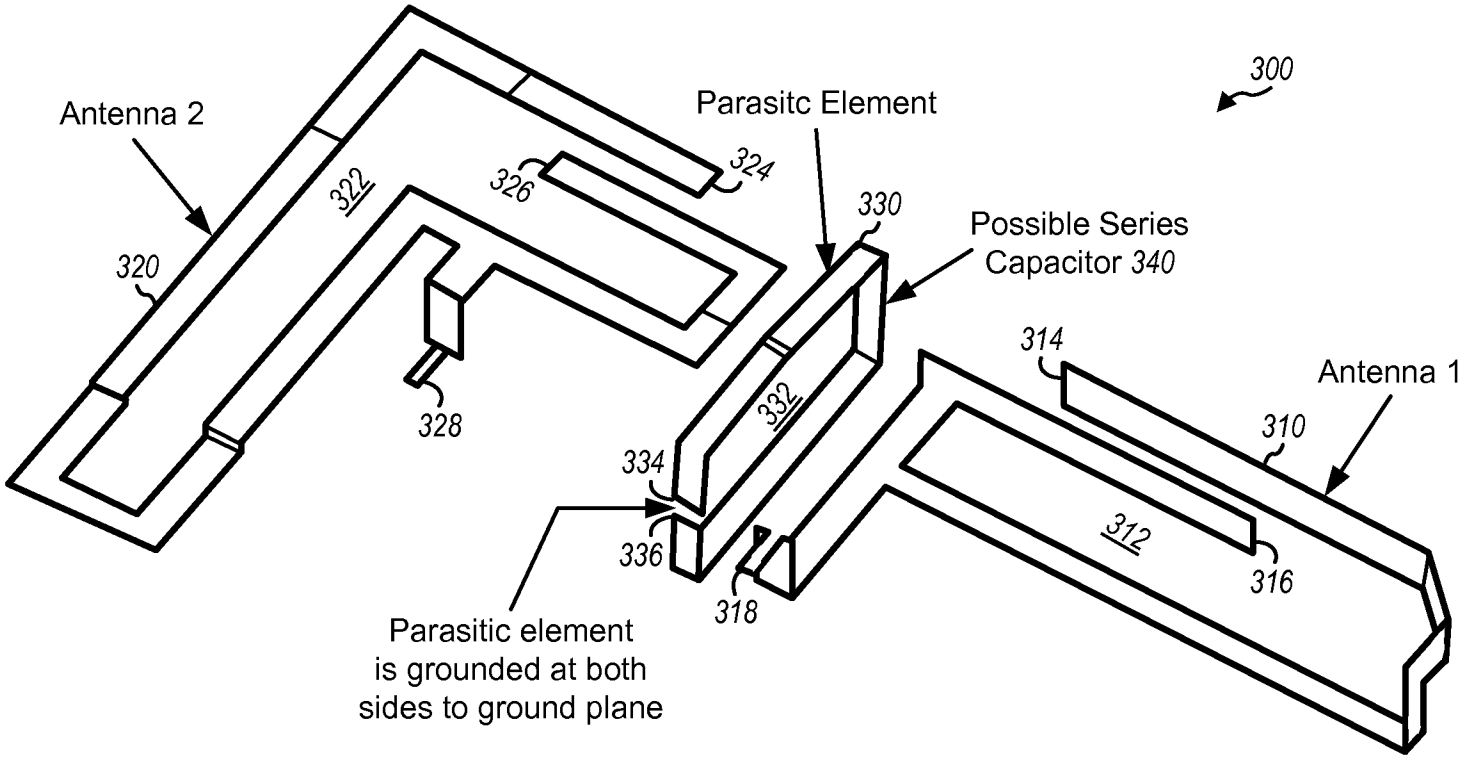
FIG. 3 shows a perspective view of a wideband antenna system with two antennas and one parasitic element.

FIG. 3 shows a perspective view of an exemplary design of a wideband antenna system 300 having good performance and good isolation. Wideband antenna system 300 includes a first antenna 310 (or antenna 1), a second antenna 320 (or antenna 2), and a parasitic element 330. Antennas 310 and 320 may be used for antennas 210 and 220, respectively, in wireless device 110 in FIG. 2. In an exemplary design, antennas 310 and 320 are monopole antennas. Antennas 310 and 320 may also be implemented with other antenna structures.

In an exemplary design shown in FIG. 3, antenna 310 is formed with an open-ended loop 312 having two ends 314 and 316 that overlap and are separated by a gap, i.e., the two ends are not in contact with one another and do not touch. The gap may be of any suitable width, may be formed with any non-conductive material including air, and may prevent electrical contact of the two ends 314 and 316. In an exemplary design, loop 312 may have a length of approximately one third to one half of a wavelength at a particular operating frequency. Antenna 310 has an antenna input 318, which receives a first TX signal from a first transmitter (not shown in FIG. 3) and provides a first RX signal to a first receiver (also not shown in FIG. 3). The layout and dimensions of various parts of antenna 310 may be selected to obtain good performance over a desired frequency range.

In an exemplary design shown in FIG. 3, antenna 320 is formed with an open-ended loop 322 having two ends 324 and 326 that overlap and are separated by a gap. In an exemplary design, loop 322 may have a length of approximately one third to one half of a wavelength. Antenna 320 has an antenna input 328, which receives a second TX signal from a second transmitter (not shown in FIG. 3) and provides a second RX signal to a second receiver (also not shown in FIG. 3). The layout and dimensions of various parts of antenna 320 may be selected to obtain good performance over a desired frequency range.

In the exemplary design shown in FIG. 3, parasitic element 330 is formed by a conductive metal trace arranged in a closed loop 332 and having two ends 334 and 336 that are coupled to ground planes. Parasitic element 330 is located between antennas 310 and 320 and performs several functions. First, parasitic element 330 provides isolation between antennas 310 and 320 and reduce signal leakage between the two antennas. Second, parasitic element 330 helps tune and improve the performance of antennas 310 and 320.

In an exemplary design, wideband antenna system 300 may be implemented on an antenna carrier, which may be mated to a circuit board. The antenna carrier may be fabricated with a non-conductive dielectric material, which may be industrial plastic such as polycarbonate. The circuit board may carry various circuit components for a wireless device. Wideband antenna system 300 may be implemented such that it occupies as little space and volume as possible, so that the antenna carrier can be as small as possible. Furthermore, wideband antenna system 300 may be implemented such that it has as little impact as possible on placement and routing of other circuit components on the circuit board.

Figure 4B:
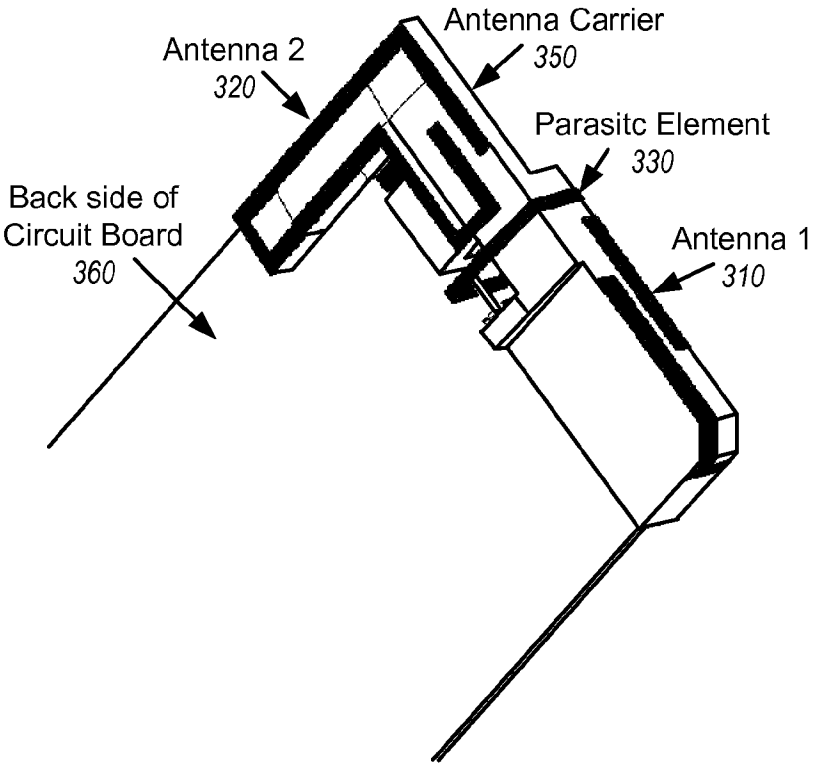
FIGS. 4A and 4B show two perspective views of the wideband antenna system on an antenna carrier.
Figure 4A:
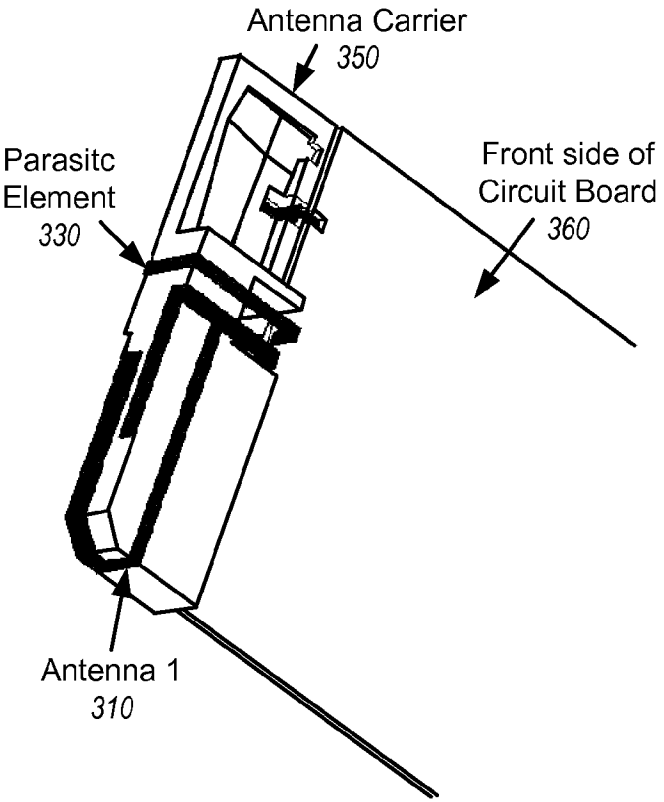

FIGS. 4A and 4B show two perspective views of an exemplary design of implementing wideband antenna system 300 on an antenna carrier 350. Antenna carrier 350 may be mated to one end of a circuit board 360, which may correspond to the top end or bottom end of a wireless device. Circuit board 360 may include various circuit components for the wireless device (not shown in FIGS. 4A and 4B). FIG. 4A shows a perspective view of the front side of circuit board 360 whereas FIG. 4B shows a perspective view of the back side of circuit board 360.

In the exemplary design shown in FIGS. 3, 4A and 4B, antennas 310 and 320 are placed side by side on antenna carrier 350 and are located at one end of a wireless device. This antenna configuration may result in a more compact layout of antennas 310 and 320 and less impact to placement and routing of circuit components. Antennas 310 and 320 may be located either at the top or bottom of a wireless device, which may provide design flexibility to meet Specific Absorption Rate (SAR) requirements and other Federal Communications Commission (FCC) regulations. The antenna configuration shown in FIGS. 3, 4A and 4B may use less volume, achieve better isolation and antenna correlation, and provide other advantages over an antenna configuration with one antenna located at the top and another antenna located at the bottom of a wireless device.

In the exemplary design shown in FIGS. 3, 4A and 4B, antennas 310 and 320 are implemented on different sides of antenna carrier 350. In particular, antenna 310 is implemented on one side of antenna carrier 350, and antenna 320 is implemented on the other side of antenna carrier 350. This antenna placement may provide various advantages such as better isolation between the two antennas, lower likelihood of both antennas being detuned by a plane object such a table, less radiation to the user since the two antennas do not radiate from the same side, etc.

In the exemplary design shown in FIGS. 3, 4A and 4B, antennas 310 and 320 have the same open-loop structure but different shapes and dimensions. The shape and dimension of antenna 310 may be selected to achieve good performance for antenna 310. Similarly, the shape and dimension of antenna 320 may be selected to achieve good performance for antenna 320. The shapes and dimensions of antennas 310 and 320 may also be determined based on other constraints such as the dimension of antenna carrier 350, the size of the wireless device on which antennas 310 and 320 are utilized, etc. The exemplary design shown in FIG. 3 may allow antennas 310 and 320 to be customized individually to obtain good performance for each antenna based on the requirements of that antenna.

In another exemplary design that is not shown in FIGS. 3, 4A and 4B, antennas 310 and 320 may have the same open-loop structure as well as the same shape and dimension. For example, either antenna 310 or 320 may be replicated and flipped 180 degrees. The two identical antennas may then be placed side by side at opposite corners of antenna carrier 350, as shown in FIGS. 3, 4A and 4B.

In the exemplary design shown in FIGS. 3, 4A and 4B, antenna 320 is formed substantially on the back side of antenna carrier 350. However, antenna 310 is formed on both the front side and top edge of antenna carrier 350, as shown in FIGS. 4A and 4B. This exemplary design may provide certain advantages. The top edge typically has the maximum clearance from the ground plane. Hence, an antenna design should try to utilize the area on the top edge if possible. However, whether the top edge is used for zero, one, or both antennas may be dependent on the overall performance of the antennas. In another exemplary design, each antenna is formed on only one side of antenna carrier 350. In this exemplary design, antenna 310 is formed on only the front side, and not the top edge, of antenna carrier 350.

The side-by-side and front-and-back configuration of antennas 310 and 320 may provide more flexibility to address hand effects and SAR issues. If both antennas 310 and 320 are placed at the top of the wireless device, then the two antennas may be much less likely to be covered by the hands of a user of the wireless device. If both antennas 310 and 320 are placed at the bottom of the wireless device, then it is unlikely that both antennas will be covered by the hands of the user, since one antenna is located on the front side and the other antenna is located on the back side. This side-by-side and front-and-back configuration of antennas 310 and 320 may thus result in less impact due to hand placement. In contrast, a top-and-bottom configuration with one antenna at the top of a wireless device and another antenna at the bottom of the wireless device may be more susceptible to being covered by the hands of a user. Antennas 310 and 320 may be designed and placed such that a good balance of SAR and hand effects can be obtained.

The side-by-side and front-and-back configuration of antennas 310 and 320 may also enable the two antennas to be implemented in a smaller volume than the top-and-bottom configuration. For example, antennas 310 and 320 may be implemented with antenna carrier 350 having a height of approximately 15 millimeters (mm). In contrast, two antennas with comparable performance may be implemented on two antenna carriers for the top-and-bottom configuration, with one antenna being implemented on one antenna carrier having a height of approximately 11 mm, and another antenna being implemented on another antenna carrier having a height of approximately 9 mm. The side-by-side and front-and-back configuration may thus reduce the overall length of the wireless device by approximately 5 mm over the top-and-bottom configuration. The side-by-side and front-and-back configuration may be more efficient in using volume resource on the wireless device.

Generally, the overall performance (e.g., the efficiency and bandwidth) of an antenna may be related to the size of the antenna, and better performance may typically be obtained with a larger antenna, and vice versa. In an exemplary design, antennas 310 and 320 have different bandwidth requirements, with the required bandwidth of antenna 310 being wider than the required bandwidth of antenna 320. Antenna 310 may then be implemented with a larger size than antenna 320. In an exemplary design, antenna 310 may occupy approximately 56% of the total volume for the two antennas, and antenna 320 may occupy approximately 44% of the total volume. The total volume may also be divided between antennas 310 and 330 based on a 55/45 split, a 60/40 split, a 65/35 split, or some other split. The percentage split for antennas 310 and 330 may be dependent on the bandwidth requirements of the two antennas and/or other factors.

In general, antennas 310 and 320 may each have any suitable shape, size, and placement. The shape, size, and placement of each antenna may be dependent on the requirements of the antenna, the space constraints of the wireless device, and/or other factors. FIGS. 3, 4A and 4B show an exemplary design of antennas 310 and 320 with specific shapes, sizes, and placements that were selected to achieve good performance over a wide frequency range, as described below. The shape, size, and placement of each antenna may also be varied from the exemplary design shown in FIGS. 3, 4A and 4B, and this is within the scope of the present disclosure.

In the exemplary design shown in FIGS. 3, 4A and 4B, parasitic element 330 is located between antennas 310 and 320 and is shared by the two antennas. Parasitic element 330 helps to improve isolation between antennas 310 and 320, especially when both are transmitting at the same time. In particular, parasitic element 330 creates a shield for both electrical field (due to implementation of parasitic element 330 with a conductive metal trace) and magnetic field (due to parasitic element 330 being a loop). The shield for both electrical field and magnetic field helps to improve isolation between antennas 310 and 320.

Parasitic element 330 also helps to create different modes of current flow at different frequencies, which may extend the bandwidth of antenna 310 and/or 320. At low frequency band (e.g., around 800 MHz), parasitic element 330 has surface current flowing in full circle along loop 332. At high frequency band (e.g., around 2100 MHz), parasitic element 330 has a current null at one point in loop 332. The current flow above the null point is toward the ground plane, and the current flow below the null point is also toward the ground plane. The null point is dependent on frequency and can shift with changes in the operating frequency.

In the exemplary design shown in FIGS. 3, 4A and 4B, antennas 310 and 320 and parasitic element 330 are implemented on different planes in three-dimensional (3D) space. In particular, antennas 310 and 320 are implemented on a first plane (e.g., x plane) of three possible planes (e.g., x, y and z planes) in 3D space. The first plane corresponds to the plane of antenna carrier 350. Parasitic element 330 is implemented on a second plane (e.g., y plane) that this perpendicular to the first plane, as shown in FIG. 3. This configuration may provide certain advantages, e.g., may allow the parasitic element to occupy less volume. In another exemplary design, parasitic element 330 may be formed on the same plane as antennas 310 and 320. For example, parasitic element 330 may be flipped 90 degrees and formed on either the front or back side of antenna carrier 350.

In another exemplary design, multiple parasitic elements may be located between antennas 310 and 320. For example, parasitic element 330 may be replicated, and the replicated parasitic element may be placed next to parasitic element 330. As another example, one parasitic element may be located on the front side next to antenna 310, and another parasitic element may be located on the back side next to antenna 320.

In an exemplary design, parasitic element 330 may be implemented with a conductive metal trace forming a loop, as shown in FIG. 3. In another exemplary design, parasitic element 330 includes a capacitor coupled in series with the loop. For example, parasitic element 330 may be broken at the point indicated by the arrow below numeral 330 in FIG. 3, and a series capacitor 340 may be inserted at this point. In one exemplary design, capacitor 340 may have a fixed value, which may be selected to obtain the desired resonant frequency for parasitic element 330 and to obtain good performance for antenna 310 and/or 330. In another exemplary design, capacitor 340 may have an adjustable value, which may be set to obtain good performance. For example, the performance of antenna 310 and/or 320 may be characterized for different possible values of capacitor 340 (e.g., during the design phase and/or manufacturing phase) and stored on the wireless device. The performance may be quantified by efficiency, isolation, etc. Thereafter, a suitable value of capacitor 340 may be selected based on the current operating frequency of the wireless device and the stored characterizations such that good performance can be obtained for antenna 310 and/or 320.

As shown in FIGS. FIGS. 3, 4A and 4B, wideband antenna system 300 may be implemented with a simple, compact, and low-cost structure. Wideband antenna system 300 may also be easy to build and may have other advantages over other antenna systems.

Figure 5A:
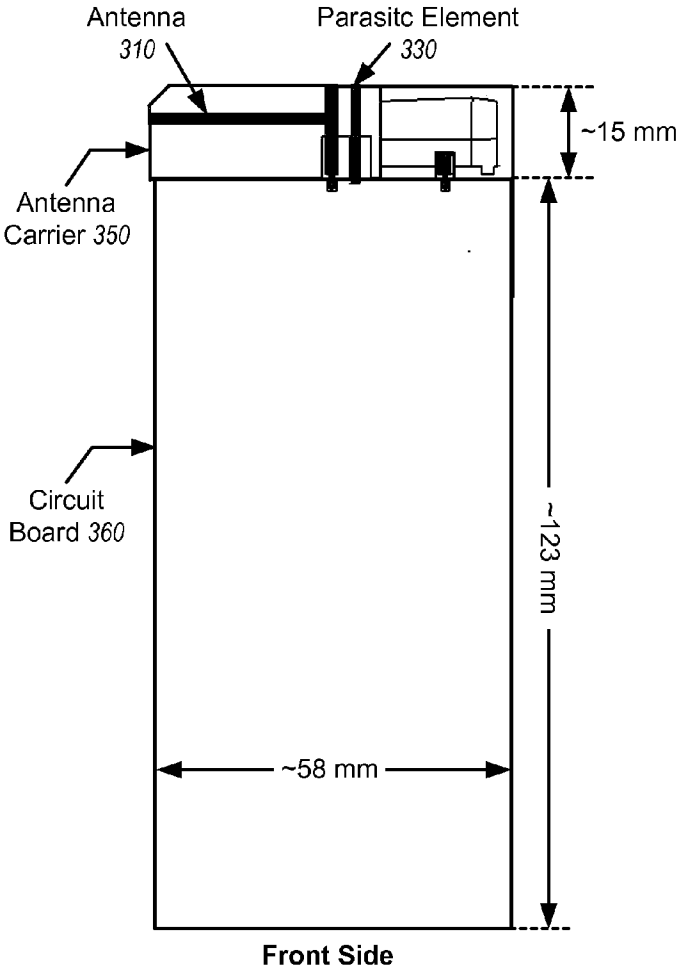
FIGS. 5A, 5B and 5C show a front view, a back view, and a side view of the wideband antenna system on the antenna carrier.

FIG. 5A shows a front view of antenna carrier 350 with wideband antenna system 300 and circuit board 360. In this front view, antenna 310 and half of parasitic element 330 are visible, and antenna 320 is not visible.

Figure 5B:
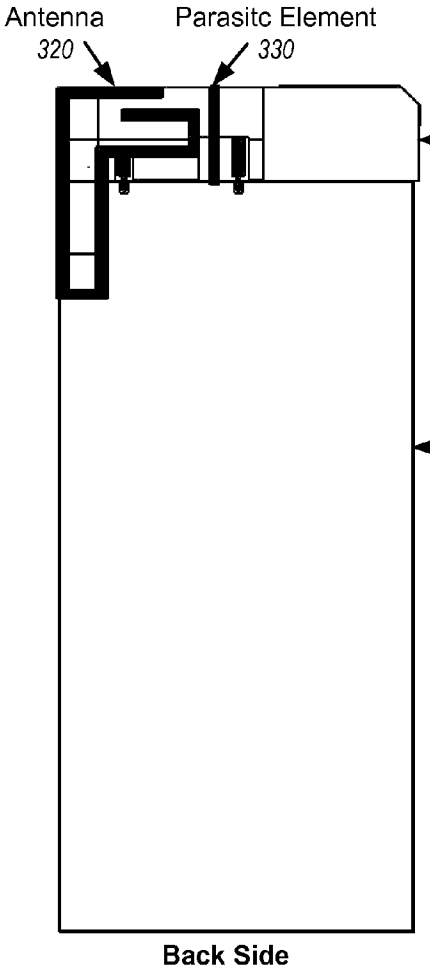

FIG. 5B shows a back view of antenna carrier 350 with wideband antenna system 300 and circuit board 360. In this back view, antenna 320 and half of parasitic element 330 are visible, and antenna 310 is not visible.

Figure 5C:
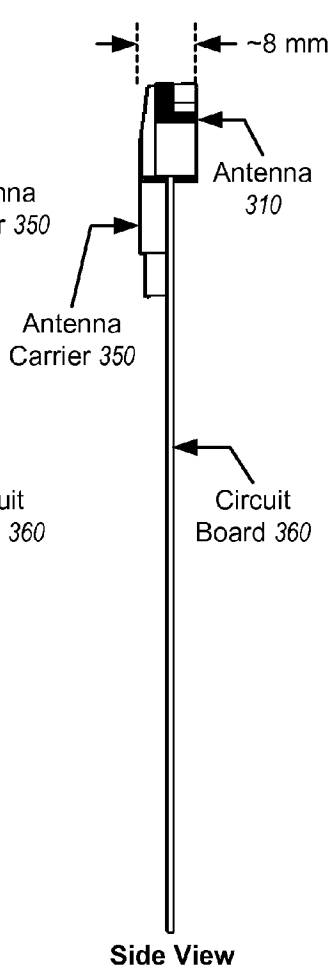

FIG. 5C shows a side view of antenna carrier 350 with wideband antenna system 300 and circuit board 360. In this side view, only part of antenna 310 is visible.

FIGS. 5A and 5C show various dimensions of antenna carrier 350 and circuit board 360 in accordance with one exemplary design. In this exemplary design, antenna carrier 350 has a width of approximately 58 mm, a height of approximately 15 mm, and a thickness of approximately 8 mm. Circuit board 360 has a width of approximately 58 mm and a height of approximately 123 mm. The dimensions of antenna carrier 350 and circuit board 360 are determined by the small size of a wireless device (e.g., a cellular phone or a smart phone) containing antenna carrier 350 and circuit board 360. As shown in FIGS. 5A and 5C, a small size of approximately 58 mm by 15 mm by 8 mm may be sufficient to implement two antennas 310 and 320 having good performance.

FIGS. 5A to 5C show specific dimensions for one exemplary design of antenna carrier 350 for wideband antenna system 300 and circuit board 360. Antenna carrier 350 and circuit board 360 may also have other dimensions, which may be dependent on the size of a wireless device, the requirements of antennas 310 and 320, etc.

FIGS. 3 to 4B show an exemplary design of parasitic element 330 with a conductive metallic trace. A parasitic element may also be implemented in other manners.

Figure 6D:
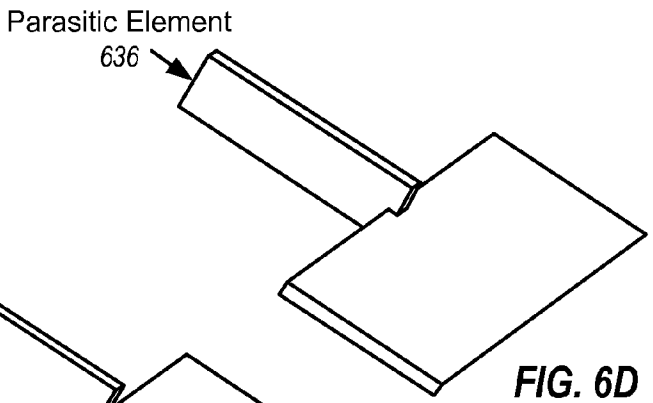
FIGS. 6A through 6D show four exemplary designs of a parasitic element.
Figure 6C:
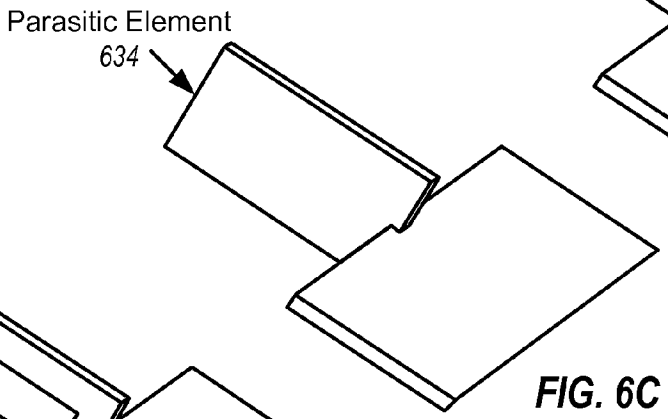
Figure 6B:
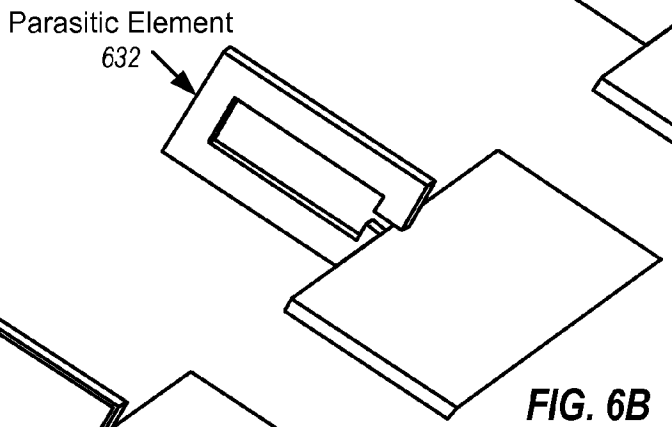
Figure 6A:
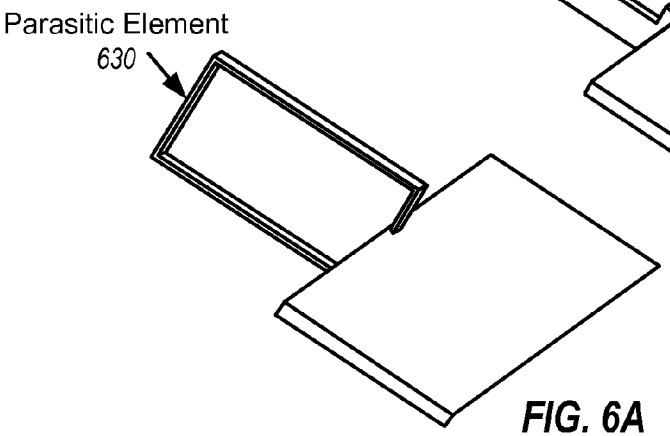

FIGS. 6A through 6D show four exemplary designs of a parasitic element that may be used for a wideband antenna system. FIG. 6A shows an exemplary design of a parasitic element 630 implemented with a conductive metal trace. Parasitic element 630 is similar to parasitic element 330 in FIG. 3. FIG. 6B shows an exemplary design of a parasitic element 632 implemented with a conductive metal trace having a thicker gauge. FIG. 6C shows an exemplary design of a parasitic element 634 implemented with a solid plate. FIG. 6D shows an exemplary design of a parasitic element 636 implemented with a more narrow plate or a rod. A parasitic element may also be implemented with other shapes, size, etc. In general, the best shape of a parasitic element may depend on various factors such as frequency requirements, dimensions of a board, etc.

Figure 7A:
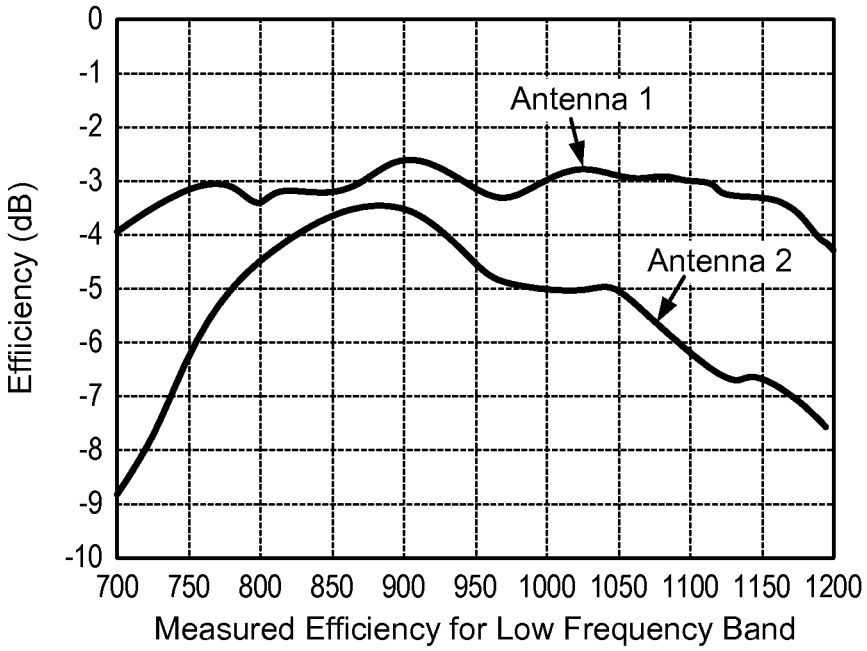
FIGS. 7A and 7B show the efficiency of the two antennas in the wideband antenna system for low and high frequency bands, respectively.

FIG. 7A shows the efficiency of antennas 310 and 320 in wideband antenna system 300 for low frequency band. The horizontal axis denotes frequency and is given in units of MHz. The vertical axis denotes efficiency and is given in units of decibels (dB). As shown in FIG. 7A, antenna 310 has an efficiency of −4 dB or better from approximately 700 MHz to approximately 1180 MHz. Antenna 310 can thus support operation from 704 MHz to 960 MHz in low frequency band. As also shown in FIG. 7A, antenna 320 has an efficiency of −4 dB or better from approximately 820 MHz to approximately 930 MHz. Antenna 320 can support both data transmission and reception with good efficiency across this frequency range. This may enable antenna 320 to provide good performance for voice and/or other services. Antenna 320 has an efficiency of −9 dB or better from 700 MHz to 1200 MHz and can support transmit and/or receive diversity across this frequency range.

Figure 7B:
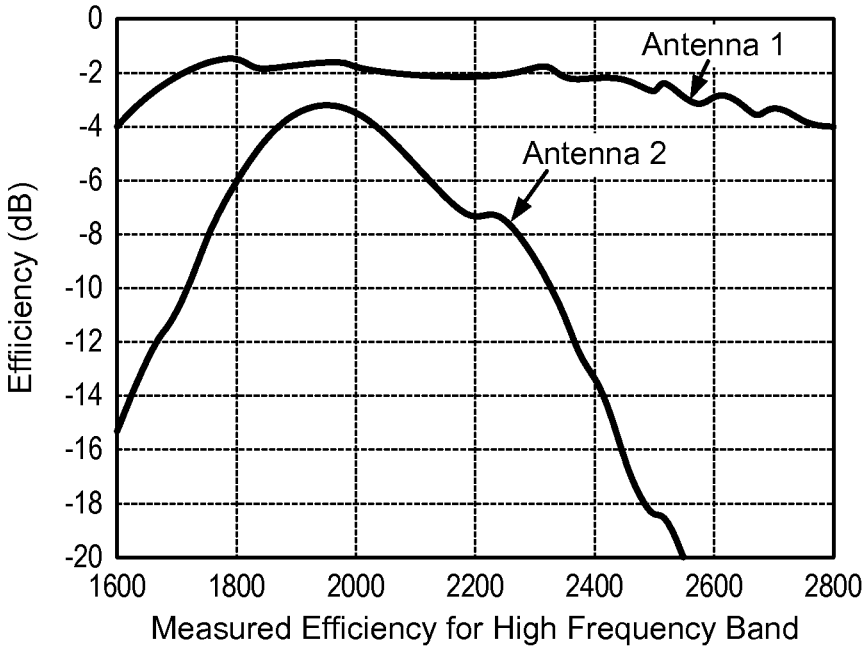

FIG. 7B shows the efficiency of antennas 310 and 320 in wideband antenna system 300 for high frequency band. As shown in FIG. 7B, antenna 310 has an efficiency of −4 dB or better from 1600 MHz to 2800 MHz. As also shown in FIG. 7B, antenna 320 has an efficiency of −4 dB or better from approximately 1860 MHz to approximately 2050 MHz. Antenna 320 may thus provide good performance for voice and/or other services over this frequency range. Furthermore, antenna 320 has an efficiency of −10 dB or better from approximately 1700 MHz to approximately 2320 MHz and can thus support transmit and/or receive diversity across this frequency range.

As shown in FIGS. 7A and 7B, based on the exemplary design shown in FIGS. 3 to 5C, antenna 310 has a wide bandwidth from 700 MHz to 1200 MHz, and from 1600 MHz to 2800 MHz. Antenna 320 supports a more narrow bandwidth. Wideband antenna system 300 can provide good performance for various applications utilizing multiple antennas over a wide frequency range.

Isolation between antennas 310 and 320 in wideband antenna system 300 was also measured and was found to be 9 dB or better across the entire frequency range from 500 MHz to 3000 MHz.

For clarity, a specific wideband antenna system 300 with two antennas 310 and 320 and one parasitic element 330 has been described in detail above. In general, a wideband antenna system may include any number of antennas and any number of parasitic elements. The number of antennas may be dependent on the requirements of a wireless device. In an exemplary design, at least one parasitic element may be located between each pair of antennas to provide isolation and possibly perform other functions. Each antenna may have any suitable shape and size, which may be dependent on the requirements of the antenna and the available space and volume.

In an exemplary design, an apparatus (e.g., a wireless device, a board such as an antenna carrier, an IC, etc.) may comprise a first antenna, a second antenna, and a parasitic element. The first antenna (e.g., antenna 310 in FIGS. 3 and 4A) may be configured to transmit and receive a first set of signals and may have a shape of an open-ended loop with two ends that overlap and are separated by a gap. The second antenna (e.g., antenna 320 in FIGS. 3 and 4B) may be configured to transmit and receive a second set of signals and may also have a shape of an open-ended loop with two ends that overlap and are separated by a gap. The parasitic element (e.g., parasitic element 330 in FIGS. 3, 4A and 4B) may be located between the first and second antennas.

In an exemplary design, the first and second antennas may be placed side by side on a board (e.g., an antenna carrier), as shown in FIG. 3. The first and second antennas may be internal to a wireless device and may be located at either the top end or the bottom end of the wireless device. In an exemplary design, the first antenna may be formed on a first side (e.g., the front side) of the board, and the second antenna may be formed on a second side (e.g., the back side) of the board opposite of the first side, as shown in FIGS. 4A and 4B. In an exemplary design, the first antenna may be formed on one side and also on one edge of the board, and the second antenna may be formed on only one side of the board, as shown in FIGS. 4A and 4B. In general, each antenna may be formed on only one side of the board, or both sides of the board, or one side and one edge of the board, or both sides and multiple edges of the board.

In an exemplary design, the first and second antennas may be formed on a first plane (e.g., x plane) in 3D space. The parasitic element may be formed on a second plane (e.g., y plane) in 3D space perpendicular to the first plane, as shown in FIG. 3. In another exemplary design, the first and second antennas and the parasitic element may be formed on the same plane.

In an exemplary design, the first and second antennas may have different shapes and/or different overall dimensions, e.g., as shown in FIG. 3. For example, the first antenna may have a rectangular shape whereas the second antenna may have an "L" shape. The first and second antennas may also have other shapes. In another exemplary design, the first and second antennas may have the same shape and the same dimension. In an exemplary design, the first and second antennas may be implemented within a volume of less than 60 mm in width, less than 20 mm in height, and less than 10 mm in thickness. In other exemplary design, the first and second antennas may be implemented within a volume of other dimensions, which may be dependent on the size of the wireless device on which the antennas are utilized.

In an exemplary design, the first antenna may have a first bandwidth, and the second antenna may have a second bandwidth that is different from the first bandwidth, e.g., as shown in FIGS. 7A and 7B. In another exemplary design, the first and second antennas may have similar bandwidth. In an exemplary design, the first antenna may support operation in a first frequency range (e.g., within 700 MHz to 1200 MHz) below a particular frequency and also in a second frequency range (e.g., within 1600 MHz to 2800 MHz) above the particular frequency. The second antenna may support operation on the same or different frequency ranges as the first antenna.

In an exemplary design, the parasitic element may comprise a conductive metal trace arranged in a closed loop and providing a shield for both electrical field and magnetic field between the first and second antennas. In an exemplary design, no other circuit components are coupled to the parasitic element. In another exemplary design, a capacitor may be coupled in series with the parasitic element. The capacitor may have a fixed value to obtain a fixed resonant frequency for the parasitic element. Alternatively, the capacitor may have an adjustable value to obtain a variable resonant frequency for the parasitic element. The performance of the first and/or second antenna may be varied by the resonant frequency of the parasitic element.

Figure 8:
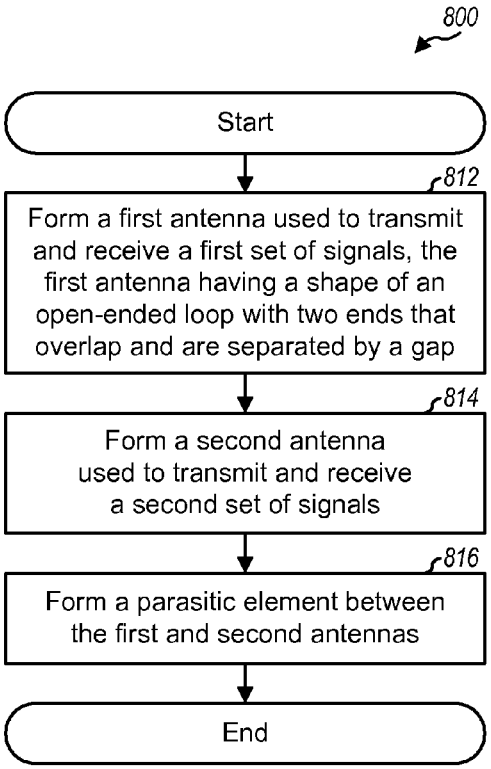
FIG. 8 shows a process for forming antennas in the wideband antenna system.

FIG. 8 shows an exemplary design of a process 800 for forming antennas. A first antenna used to transmit and receive a first set of signals may be formed. The first antenna may have a shape of an open-ended loop with two ends that overlap and are separated by a gap, e.g., as shown in FIG. 3 (block 812). A second antenna used to transmit and receive a second set of signals may also be formed (block 814). The second antenna may also have a shape of an open-ended loop with two ends that overlap and are separated by a gap, e.g., as shown in FIG. 3. A parasitic element may be formed between the first and second antennas, e.g., as shown in FIG. 3 (block 816).

In an exemplary design, the first and second antennas may be formed side by side on a board. The first and second antennas may be internal to a wireless device and may be located at either the top end or the bottom end of the wireless device. In an exemplary design, the first antenna may be formed on a first side (e.g., the front side) of the board, and the second antenna may be formed on a second side (e.g., the back side) of the board opposite of the first side. The first and second antennas may have various characteristics and attributes, as described above.

Figure 9:
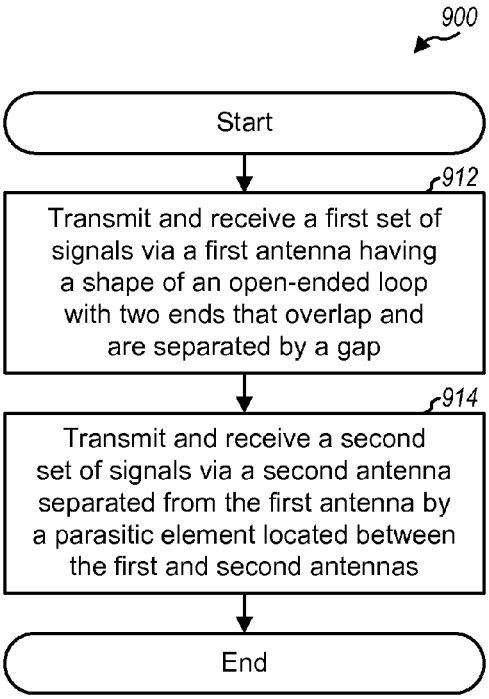
FIG. 9 shows a process for using antennas in the wideband antenna system.

FIG. 9 shows an exemplary design of a process 900 for using antennas. A first set of signals may be transmitted and received via a first antenna having a shape of an open-ended loop with two ends that overlap and are separated by a gap (block 912). A second set of signals may be transmitted and received via a second antenna, which may be separated from the first antenna by a parasitic element located between the first and second antennas (block 914). The second antenna may also have a shape of an open-ended loop with two ends that overlap and are separated by a gap.

In an exemplary design, the first antenna may be operated over a first frequency range, which may cover one or more frequency bands. The second antenna may be operated over a second frequency range, which may be similar to or different from the first frequency range. The first and second antennas may have various characteristics and attributes, as described above.

In an exemplary design, a value of a capacitor coupled in series with the parasitic element may be adjusted to vary a resonant frequency of the parasitic element. This adjustment may improve the performance of the first and/or second antenna.

The wideband antenna system described herein may be implemented on an IC, an analog IC, an RFIC, a mixed-signal IC, an ASIC, a printed circuit board (PCB), an electronic device, etc. The wideband antenna system may also be fabricated with various IC process technologies.

An apparatus implementing the wideband antenna system described herein may be a stand-alone device or may be part of a larger device. A device may be (i) a stand-alone IC, (ii) a set of one or more ICs that may include memory ICs for storing data and/or instructions, (iii) an RFIC such as an RF receiver (RFR) or an RF transmitter/receiver (RTR), (iv) an ASIC such as a mobile station modem (MSM), (v) a module that may be embedded within other devices, (vi) a receiver, cellular phone, wireless device, handset, or mobile unit, (vii) etc.

In one or more exemplary designs, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

The previous description of the disclosure is provided to enable any person skilled in the art to make or use the disclosure. Various modifications to the disclosure will be readily apparent to those skilled in the art, and the generic principles defined herein may be applied to other variations without departing from the scope of the disclosure. Thus, the disclosure is not intended to be limited to the examples and designs described herein but is to be accorded the widest scope consistent with the principles and novel features disclosed herein.

What is claimed is:

1. An apparatus comprising: a first antenna configured to transmit and receive a first set of signals, the first antenna having a shape of an open-ended loop with two ends that overlap and are separated by a gap; a second antenna configured to transmit and receive a second set of signals; and a parasitic element having a shape of an open-ended loop with two separate ends that are respectively coupled to two respective opposing surfaces of at least one ground plane on respective opposing surfaces of a printed circuit board, the parasitic element located between the first and second antennas, wherein the at least one ground plane disposed at least partially within a gap separating the two separate ends of the open-ended loop of the parasitic element.

2. The apparatus of claim 1, the second antenna having a shape of an open-ended loop with two ends that overlap and are separated by a gap.

3. The apparatus of claim 1, the first and second antennas being placed side by side on a board.

4. The apparatus of claim 1, the first and second antennas being internal to a wireless device and located at either a top end or a bottom end of the wireless device.

5. The apparatus of claim 1, the first antenna being formed on a first side of a board, and the second antenna being formed on a second side of the board opposite of the first side.

6. The apparatus of claim 1, the first and second antennas being formed on a first plane in three-dimensional (3D) space, and the parasitic element being formed on a second plane in 3D space perpendicular to the first plane.

7. The apparatus of claim 1, the first and second antennas having different shapes.

8. The apparatus of claim 1, the first and second antennas having different overall dimensions.

9. The apparatus of claim 1, the first and second antennas being formed within a volume of less than 60 millimeter (mm) in width and less than 20 mm in height.

10. The apparatus of claim 1, the first and second antennas being formed within a volume of less than 10 millimeter (mm) in thickness.

11. The apparatus of claim 1, the first antenna having a first bandwidth, and the second antenna having a second bandwidth different from the first bandwidth.

12. The apparatus of claim 1, the first antenna supporting operation in a first frequency range below a particular frequency and also in a second frequency range above the particular frequency.

13. The apparatus of claim 1, the parasitic element comprising a conductive metal trace arranged in the loop and providing a shield for both electrical field and magnetic field between the first and second antennas.

14. The apparatus of claim 1, the parasitic element comprising a conductive metal trace or wire forming the loop.

15. The apparatus of claim 14, further comprising a capacitor coupled in series with the loop of the parasitic element.

16. The apparatus of claim 15, the capacitor having an adjustable value to vary a resonant frequency of the parasitic element.

17. The apparatus of claim 1, the apparatus comprising an integrated circuit.

18. A method comprising: forming a first antenna used to transmit and receive a first set of signals, the first antenna having a shape of an open-ended loop with two ends that overlap and are separated by a gap; forming a second antenna used to transmit and receive a second set of signals; and forming a parasitic element having a shape of an open-ended loop with two separate ends that are coupled to two respective opposing surfaces of at least one ground plane on respective opposing surfaces of a printed circuit board, the parasitic element located between the first and second antennas, wherein the at least one ground plane is disposed at least partially within a gap separating the two separate ends of the open-ended loop of the parasitic element.

19. The method of claim 18, the forming the second antenna comprises forming the second antenna having a shape of an open-ended loop with two ends that overlap and are separated by a gap.

20. The method of claim 18, the first and second antennas being formed side by side on a board, being internal to a wireless device, and being located at either a top end or a bottom end of the wireless device.

21. The method of claim 18, the first antenna being formed on a first side of a board, and the second antenna being formed on a second side of the board opposite of the first side.

22. An apparatus comprising: means for forming a first antenna used to transmit and receive a first set of signals, the first antenna having a shape of an open-ended loop with two ends that overlap and are separated by a gap; means for forming a second antenna used to transmit and receive a second set of signals; and means for forming a parasitic element having a shape of an open-ended loop with two separate ends that are coupled to two respective opposing surfaces of at least one ground plane on respective opposing surfaces of a printed circuit board, the parasitic element located between the first and second antennas, wherein the at least one ground plane is disposed at least partially within a gap separating the two separate ends of the open-ended loop of the parasitic element.

23. The apparatus of claim 22, the first and second antennas being formed side by side on a board, being internal to a wireless device, and being located at either a top end or a bottom end of the wireless device.

* * * * *